US005113732A

United States Patent [19]

Hänsch

[11] Patent Number: 5,113,732

[45] Date of Patent: May 19, 1992

[54] APPARATUS FOR PREPARING WIRE PIECES FOR A STAPLING MACHINE

[75] Inventor: Egon Hänsch, Wetzikon, Switzerland

[73] Assignee: Ferag AG, Hinwil, Switzerland

[21] Appl. No.: 654,377

[22] Filed: Feb. 12, 1991

[30] Foreign Application Priority Data

Feb. 13, 1990 [CH] Switzerland ..... 00460/90

[51] Int. Cl.[5] ..... B25C 5/00

[52] U.S. Cl. ..... 83/154; 83/158; 83/162; 83/245; 83/261; 83/580; 227/91; 227/99

[58] Field of Search ..... 227/81, 85, 87, 91, 227/99; 83/151, 907, 950, 158, 162, 245, 261, 580, 154

[56] References Cited

U.S. PATENT DOCUMENTS

| | | | |
|---|---|---|---|
| 3,653,570 | 4/1972 | Alsop | 227/81 |
| 3,762,622 | 10/1973 | Noren | 227/81 |
| 4,204,626 | 5/1980 | Kutnzer et al. | 227/81 |
| 4,223,823 | 9/1980 | Kutzner et al. | 227/81 |

FOREIGN PATENT DOCUMENTS

| | | |
|---|---|---|
| 1073486 | 9/1954 | France . |
| 1220597 | 5/1960 | France . |
| 2411071 | 7/1979 | France . |
| 2432920 | 3/1980 | France . |
| 637745 | 4/1950 | United Kingdom . |
| 877596 | 9/1961 | United Kingdom . |

*Primary Examiner*—Frank T. Yost
*Assistant Examiner*—John M. Husar
*Attorney, Agent, or Firm*—Willian Brinks Olds Hofer Gilson & Lione

[57] ABSTRACT

A wire piece forming device includes a wire piece dispenser with a cutting mechanism, a receiver member which receives wire pieces from the dispenser and a take-over member. The wire piece dispenser includes a feed device for the stepwise feeding of the wire. The device includes feed wheels which are driven intermittently by a four-bar linkage and a freewheel. A wire guide member is provided to ensure that the beginning of the wire is reliably inserted into a groove-like recess in a receiver member. The groove-like recess is open at its bottom. Before a wire piece is cut off by a cutter, the groove-like recess is closed by a take-over member moving past the opening of the recess. The take-over member then takes the separated wire piece and carries it away.

18 Claims, 6 Drawing Sheets

APPARATUS FOR PREPARING WIRE PIECES FOR A STAPLING MACHINE

BACKGROUND

The present invention relates to an apparatus for preparing wire pieces from a wire for use in a stapling machine which staples together multipage printed products, such as newspapers, magazines and the like, and more particularly to a wire preparing apparatus which includes a wire feeding device and a wire cutting device.

An apparatus of this kind is known for example from U.S. Pat. No. 3,762,622. The apparatus disclosed in this reference includes a wire piece dispenser. The dispenser includes a feed device which feeds a wire to a cutting device in a stepwise manner. The cutting device includes a lever-like cutting tool which is driven to rotate about an axis which extends parallel to the wire feed direction. The radial end region of the cutting tool is provided with driver teeth which impinge on the forwardly fed starting region of the wire and, with the cooperation of a stationary cutter, cut or separate a piece of the wire. After the wire piece is cut, it is held between the cutting tool, the driver teeth, and a circular guide member and carried over an angle of about 90° with the cutting tool and then fed to a receiver member. The receiver member includes a receiving gap which is bounded by a stationary block and a leaf spring. The receiving gap also tangentially adjoins the path of movement of the driver teeth, and extends at right angles to the wire piece in its longitudinal direction. The wire piece is held in the receiving gap by means of the leaf springs. The wire piece is inserted into the receiving gap as it slides off the driver teeth and held there by means of the leaf springs. A rotating stapling head includes a driver member which projects outward in the radial direction. The driver member has a driver flank which impinges on the wire piece as the stapling head moves past the receiving gap and which takes over the wire piece and carries it away. The wire piece held by the driver member is thereupon bent to form an open staple. Then, the stapling head pushes the open staple through a plurality of webs of paper lying one on the other. The staple is then bent closed.

This known apparatus has the disadvantage that heavy shocks occur whenever the cutting tool strikes against the wire. In addition shocks are caused because the wire piece must be cut through at the same time as it is accelerated, which may lead to unsteady operation of the apparatus. This known apparatus has other disadvantages. For example, it takes up a great deal of space and has severe limitations with respect to the handling of wires of different diameters.

Therefore, in view of these and other disadvantages of existing devices, it is an object of the present invention to provide a smooth-running, space-saving apparatus which permits problem-free handling of wires of different diameters.

SUMMARY OF THE INVENTION

To achieve these and other objects, the apparatus of the present invention comprises a wire piece dispenser which includes a cutting mechanism, a receiver member, and a take-over member. The starting region of the wire is introduced into a groove-like recess in the receiver member. The recess surrounds the wire piece with some tolerance. The dimensions of the wire are therefore not critical for the apparatus. In addition this arrangement makes it possible to handle even slightly bent wires. The dimensions of the opening of the recess are also large enough for the piece separated from the wire to pass through without problems. The opening is closed, at the latest by the end of the cutting operation, by the take-over member which is adapted to move past the receiver member. With this arrangement, the wire piece is not free to fall out of the recess, but rather is held in the recess until the wire piece is gripped and carried away by the take-over member. The wire piece is thus taken over by the take-over member approximately at the position where it is cut off from the wire.

In a preferred embodiment, the recess has a shape such that in a case where a wire is beginning to be introduced obliquely towards the bottom of the recess, the piece of wire which is to be cut off is aligned so as to lie approximately parallel to the take-over member. This preferred arrangement thus provides problem-free take-over of the wire piece.

In another preferred embodiment of the invention the wire piece passes into a groove-like depression in the driver member, where it is held by means of a magnet. The wire piece can thus be carried away by the receiver member in a particularly simple manner.

DETAILED DESCRIPTION OF THE PRESENTLY PREFERRED EMBODIMENTS

Figure 1:
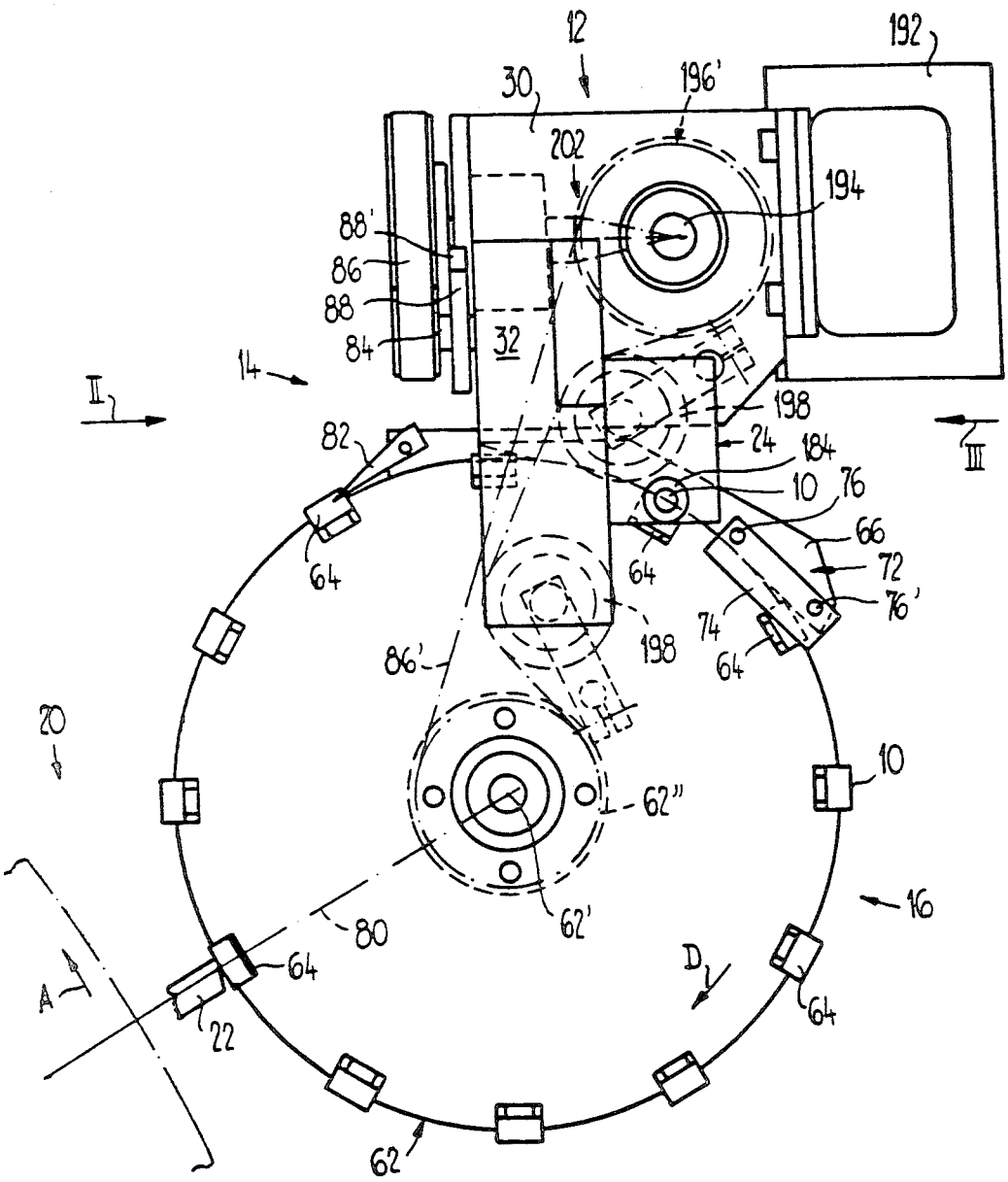
FIG. 1 is an elevational view of an apparatus according to a preferred embodiment of the invention, comprising a wire piece dispenser and a invention, comprising a wire piece dispenser and a plurality of take-over members disposed on a take-over wheel.

The present invention will now be described more fully with the aid of an example of a preferred embodiment which is illustrated in the accompanying purely schematic drawings.

Referring now to the drawings, an apparatus for preparing wire pieces 10 comprises a wire piece dispenser 14 which is driven by a drive unit 12, and a wheel-shaped take-over device 16 which is also driven by the drive unit 12. The wire pieces 10 are prepared by the wire piece dispenser 14 from a wire 18. The wire pieces 10 are taken from the wire piece dispenser 14 by a take-over device 16 which in turn supplies them to a stapling machine 20 (illustrated schematically).

A suitable stapling machine 20 comprises a plurality of stapling heads which are disposed one behind the other and which rotate in the direction of the arrow A.

Such a stapling machine is described in detail in Swiss Patent Application 01 964/89-3 and the corresponding U.S. Pat. application Ser. No. 07/528,735. In addition, stapling heads particularly suitable for taking over wire pieces 10 are disclosed in Swiss Patent Application 01 963/89-1 and the corresponding U.S. Pat. application Ser. No. 07/527,749. A punch 22 of a stapling head is illustrated in FIG. 1.

Preferably, the wire piece dispenser 14 comprises a cutting device 24, and a supply device 26 which includes a feed device 28. The feed device 28 feeds the wire 18 in a stepwise manner to the cutting device 24. These components are disposed on a substantially cuboidal bearing block 32 which is fastened on a bearing plate 30 of the drive unit 12.

Figure 3:
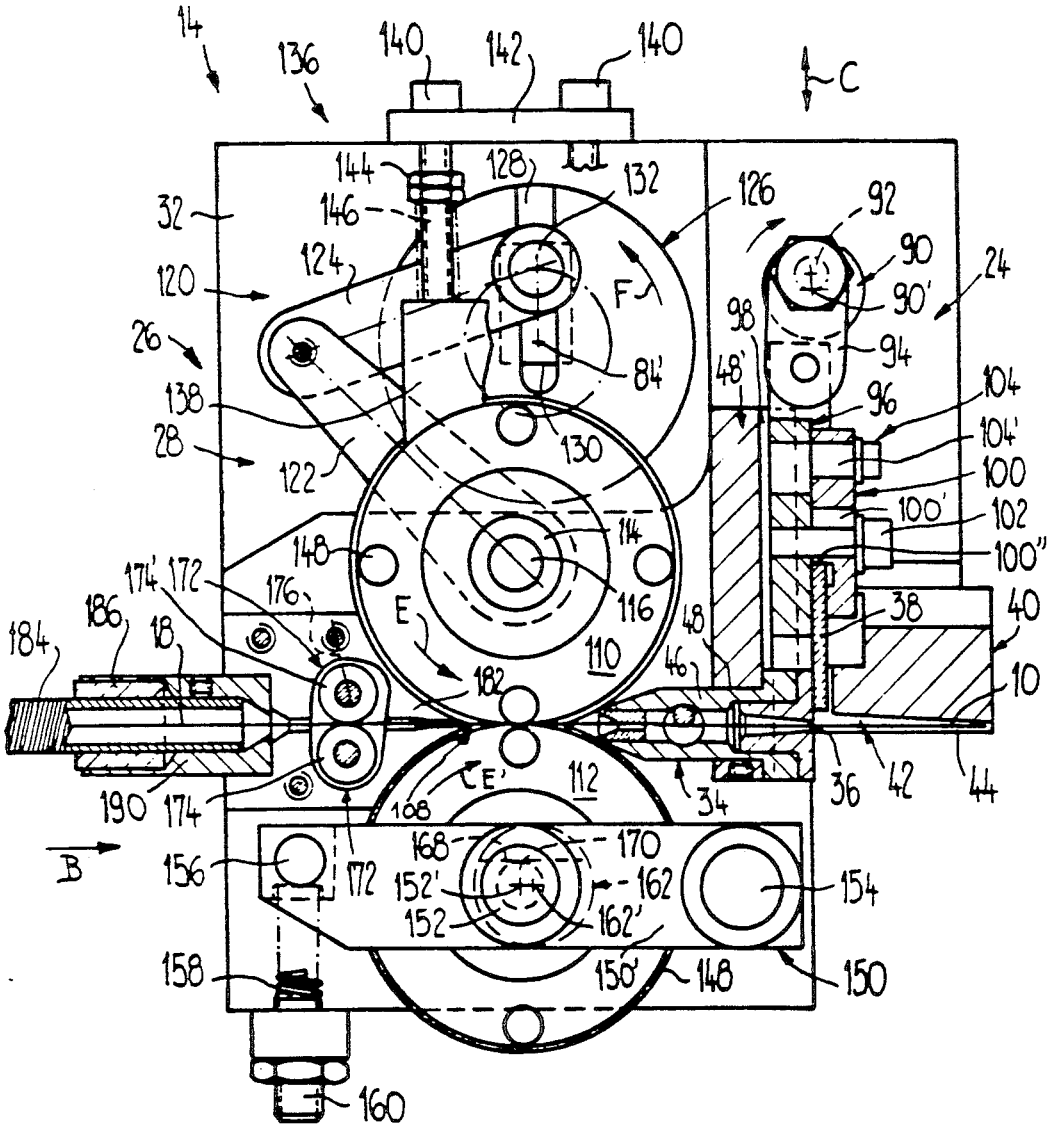
FIG. 3 is a side view of the wire piece dispenser, viewed in the direction of the arrow III in FIG. 1, partly in section and on a larger scale

The supply device 26 includes a substantially tubular wire guide member 34 for guiding the wire 18. The outlet 36 of the wire guide member 34 has a round cross-section and a nozzle-like construction. Referring to FIG. 3, the direction B is the direction in which the wire 18 is supplied. When viewed in this direction B, the wire guide number 34 follows or is downstream of the feed device 28. The feed device 28 cooperates with a cutter 38 to form the wire pieces 10. As illustrated, the cutter 38 is adapted to move up and down in the direction of the arrow C in the cutting device 24. The cutter 38 is preferably made from a flat iron bar and is of blunt construction, which contributes towards a particularly long useful life.

Figure 6:
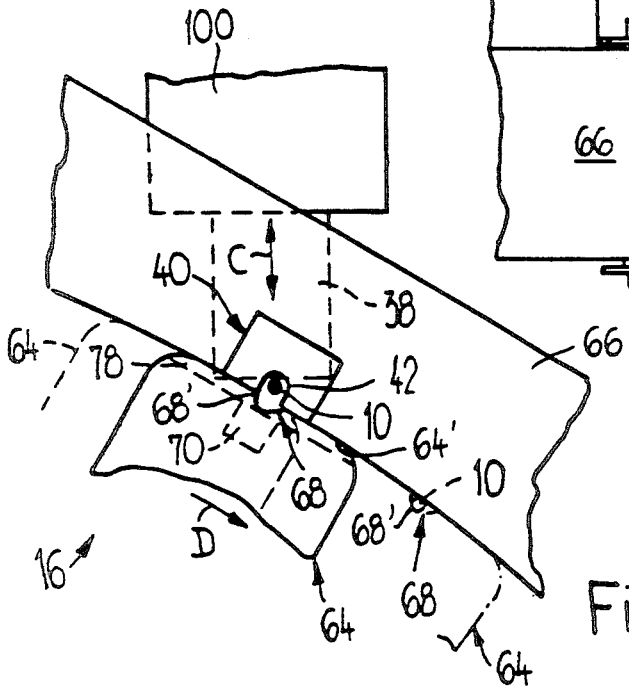
FIG. 6 is an elevational view on a larger scale of part of FIG. 1, showing a take-over member taking over a wire piece.

Viewed in the supply direction B, the cutter 38 is followed by a receiver member 40, which is provided with a groove-like recess 42 open obliquely in the downward direction (best illustrated in FIGS. 3 and 6). The recess 42 is open at both ends (when viewed in the supply direction B). The length of the receiver member 40, and thus of the recess 42, corresponds approximately to the longest length of the wire pieces 10 which are to be prepared.

Preferably, the recess 42 is approximately U-shaped in cross-section and has dimensions such that it surrounds the largest diameter of the wire 18 which has to be handled (for example about 1 millimeter) with some tolerance. The opening of the recess 42 has dimensions which are also large enough for the wire piece 10, which is cut off from the wire 18, to fall freely downwards out of the recess 42. The opening 44 is disposed slightly below the outlet 36 such that the starting region of the wire 18 which is pushed into the recess 42 comes to lie inside this recess 42. The end of the recess 42 which faces the outlet 36 is deeper than the end of the recess 42 which is remote from the outlet 36. This arrangement ensures that even if the wire 18 is inserted obliquely upwards into the recess 42, it is aligned such that it extends approximately parallel to the opening 44 and thus in the longitudinal direction of the wire guide member 34.

Figure 4:
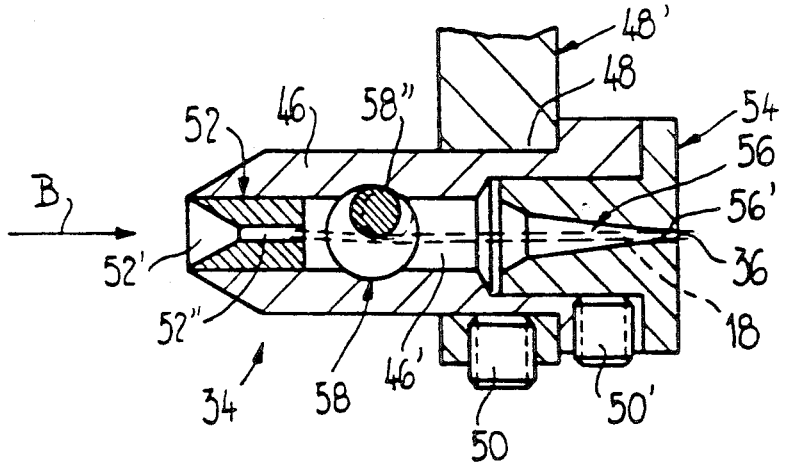
FIGS. 4 and 5 are a vertical section and a plan view, respectively, on a larger scale in comparison with FIG. 3, of a wire guide member of the wire piece dispenser.
Figure 5:
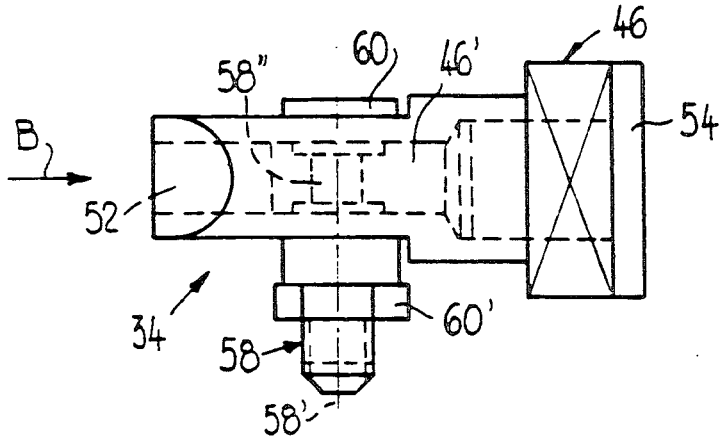

The wire guide member 34 is shown on a larger scale in FIGS. 4 and 5. This wire guide member 34 comprises a tubular part 46 which is shaped approximately as a hollow cylinder. The tubular part 46 is inserted into a bore 48 which extends in the supply direction B through a holding plate 48' projecting from the bearing block 32. The tubular part 46 is clamped fast in the bore 48 of the holding plate 48' by means of a screw 50.

A guide sleeve 52 is inserted into the inlet end (relative to the supply direction B) of the tubular part 46. The inlet 52' of the guide sleeve is conically tapered such that when the wire 18 is inserted the beginning of the wire will be guided into the guide bore 52'' which follows the inlet 52'.

A peg-like guide member 54 is inserted into the end region of the tubular part 46 remote from the guide sleeve 52. The peg-like guide member 54 is held in the tubular part 46 by means of a screw 50' which passes in the radial direction through the wall of the tubular part 46. The guide member 54 includes a passage 56 which has a round cross-section and extends in the supply direction B. The passage 56 has the shape of a nozzle which narrows substantially from the free cross-section of the tubular part 46 to a cylindrical passage part 56'. The free cross-sections of the guide bore 52'' and of the passage part 56' are slightly larger than the diameter of the thickest wire 18 which is to be handled. The end of the passage 56 defines the outlet 36.

A pin 58 passes through the tubular part 46 in the region between the guide sleeve 52 and the guide member 54. The axis 58' (indicated by a dot-dash line) of the pin 58 extends approximately horizontally and at right angles to the supply direction B. The pin 58 has a portion 58'' with a narrowed cross-section in the region of the interior space 46' bounded by the tubular part 46. This narrowed pin portion 58'' of the pin is preferably disposed eccentrically relative to the axis 58'. The pin 58, which includes a head 60 at one end, is rotatable about the axis 58'. A nut 60' is screwed onto the pin 58 and disposed, relative to the tubular part 46, at the opposite end to the head 60 The pin 58 can be fastened in the desired angular position by means of the nut 60'.

The pin portion 58'' forms a guide means which can be brought to bear against the wire 18 (indicated in FIG. 4 by the broken lines) from above by turning the pin 58. When the pin portion 58'' is in its uppermost position, the wire 18 can extend substantially rectilinearly from the guide bore 52'' to the passage part 56'. However, when the pin portion 58'' is brought for example into the position indicated in dot-dash lines in FIG. 4 by turning the pin 58, the piece of the wire 18 lying in the interior space 46' is pressed in the downward direction. As illustrated in FIG. 3, pressing the wire 18 downward causes the starting section of the wire 18 (the section of the wire which passes out of the wire guide member 34 at the outlet 36) to extend obliquely upwards. Thus, pressing the wire 18 downward ensures that the starting point or starting region of the wire 18 will always come to lie within the recess 42 in the receiver member 40.

This arrangement of the wire guide member 34 permits the handling even of a wire 18 which has a slight natural curvature without the need to straighten the wire. Such wires with a slight natural curvature may be, for example, wires drawn off from a magazine wheel. To this end, the narrowed pin portion 58'' applies a force to the wire 18 which causes the wire 18 to turn about its own length so that the natural curvature is directed upwards.

The take-over device 16 (FIGS. 1, 2, 6) preferably comprises a take-over wheel 62 driven to rotate in the direction of the arrow D, and twelve take-over members 64. Preferably, the take-over members 64 are disposed along the periphery of the take-over wheel 62 with resilient outward biasing in the radial direction. The axis of rotation 62' of the take-over wheel 62 extends parallel to the supply direction B so that the take-over members 64 move past the receiver member 40 at right angles to the longitudinal extent of the recess 42 in the take-over members 64.

A link 66, which cooperates with the take-over members 64, is fastened on the bearing block 32. A receiver member 40 is inserted in the middle region of the link 66. When viewed in the direction of rotation D, the distance between the link 66 and the axis of rotation 62' of the take-over wheel 62 decreases towards a point upstream of the receiver member 40, forming an inlet at the starting end. Downstream of the receiver member 40, the distance between the link and the axis increases again to form an outlet. The free end region 64', cooperating with the link 66, of each take-over member 64 is in the form of a sliding shoe. The middle section of the free end region 64' of the take-over member 64 includes a depression 68 which extends parallel to the axis of rotation 62'. The boundary of the depression 68' on the downstream side (relative to the direction of the arrow D) forms a driver flank 68' for the respective wire piece 10. The bottom region of the depression 68 is preferably provided with a magnet 70 in order to secure the wire piece 10. When a take-over member 64 runs onto the link 66, it is pressed radially inwards so that the end region 64' (which is in the form of a sliding shoe) lies against the link 66.

The movement of the take-over members 64 in the direction of rotation D and the movement of the cutter 38 are synchronized such that, as a take-over member 64 moves past the recess 42, the take-over member 64 closes the opening 44 at the latest by the end of the cutting operation of a wire piece 10 from the wire 18. In this manner, the wire piece 10 is prevented from falling out of the recess 42. The position of a take-over member 64 just closing the opening 44 is shown in broken lines in FIG. 6. The wire piece 10 then falls downwards, by its own weight and the pull of the magnet 70, into the depression 68 which is passing. The wire piece 10 is held fast in the depression by the magnet 70 and carried along by the driver flank 68' (as indicated in dot-dash lines). The cutting-off of a wire piece 10 must therefore be completed at the earliest when the opening 44 is closed by a take-over member 64 and at the latest as the depression 68 moves past the opening 44. This provides some tolerance in the synchronization of the cutting device 24 and the take-over device 16.

Figure 7:
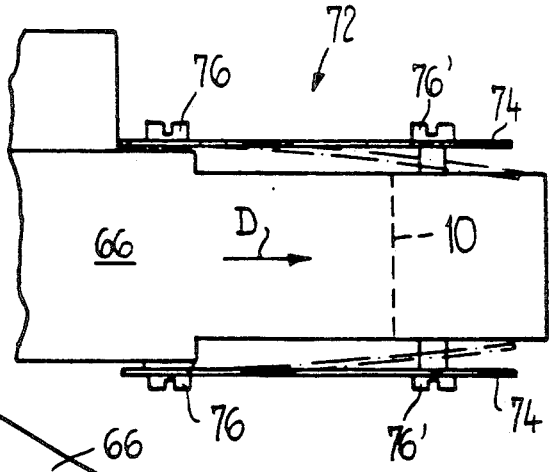
FIG. 7 is a plan view of a preferred embodiment of a wire piece straightening device.
Figure 8:
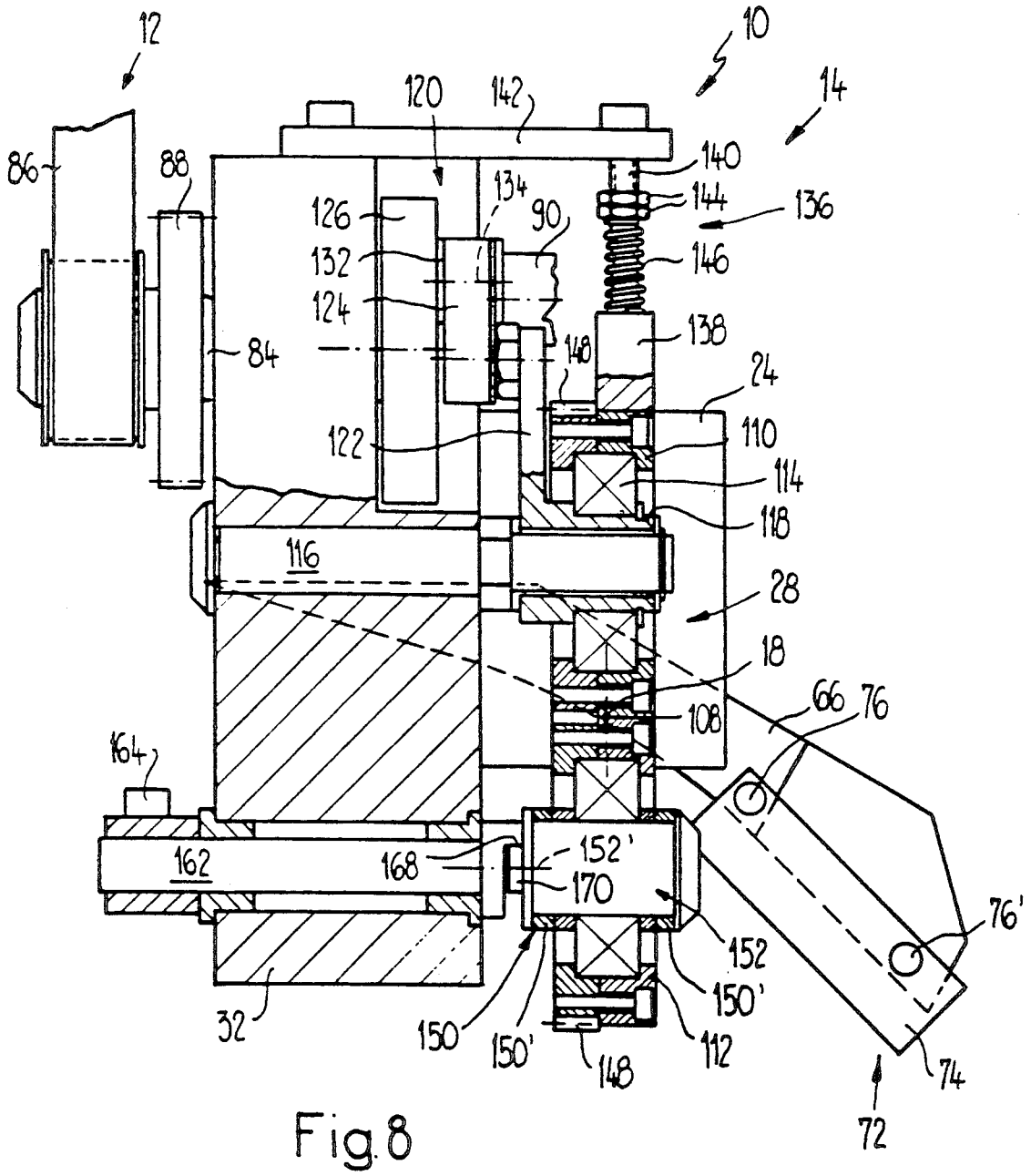
FIGS. 8 and 9 are an elevational and a plan view, respectively, partly in section, of the wire piece dispenser.

A wire piece straightening device 72 is disposed on the link 66 following the receiver member 40 in the direction of rotation D. This wire piece straightening device 72 comprises two spring steel plates 74 (FIGS. 1, 7, 8). When viewed in the direction of rotation D, the spring steel plates 74 are fastened in their starting region on the link 66 by means of screws 76 on each side of the link 66. Downstream of the screws 76, the width of the link 66 undergoes stepwise narrowing. A screw 76' passes through each spring steel plate 74 in the end region of the link 66 and is screwed into the link 66. Turning the screws 76' enables the plates 74 to be individually adjusted between the positions shown in solid lines and in dot-dash lines in FIG. 7. A wire piece 10, shown as a broken line, is held laterally offset relative to the corresponding take-over member 64. The end of this laterally offset wire piece 10 runs into the region of the corresponding spring steel plate 74 which projects downwards from the link 66. Further movement in the direction of the arrow D causes wire piece 10 to be aligned relative to the take-over member 64 and pushed into the middle.

Each take-over member 64 has a groove 78 in the middle region which extends in the direction of rotation D (FIG. 6). If a take-over member 64 with a wire piece 10 is situated in the delivery position (shown as a dot-dash line 80 in FIG. 1), the punch 22 of a stapling head moves past in the direction of the arrow A at a speed higher than the peripheral speed of the take-over members 64. The punch 22 engages in the groove 78, frees the corresponding wire piece 10 from the depression 68, and carries this wire piece with it.

A wedge-shaped wire stripper 82 (FIG. 1) is disposed upstream of the link 66. The wedge-shaped wire stripper 82 engages in the grooves 78 as the take-over members 64 move past in order to remove any wire pieces 10 which a punch 22 may have failed to take out.

A drive shaft 84 is mounted to rotate freely on the bearing block 32. The drive shaft 84 is connected to the drive unit 12 by a cogged belt 86 (FIGS. 1, 2, 8, 9). A gear 88 is mounted on the drive shaft 84 for rotation with the latter. The gear 88 meshes with another gear 88' which is mounted on a cutter drive shaft 90. The cutter drive shaft 90 is in turn also mounted on the bearing block 32.

The cutter drive shaft 90 is provided with a pin 92 in its end region facing the cutting device 24. This pin 92 is disposed eccentrically relative to the axis of rotation 90' of the shaft 90. The pin 92 is connected by a link plate 94 to a cutter slide 96. The cutter slide 96 is guided to slide up and down (in the direction of the arrow C) in a slot-like guide 98 in the holding plate 48'. As illustrated in FIG. 3, a clamp member 100 is tightened against the cutter slide 96 by means of a screw 102 in order to fasten the cutter 38, by clamp action, to the cutter slide 96. The screw 102 passes through an elongated slot 100' which extends in the direction of the arrow C in the clamp member 100. The clamp member 100 includes a stop 100" for the cutter 38. The elongated slot 100 in cooperation with the screw 102 provide adjustment of the clamp member 100 relative to the cutter slide 96. In order to enable this adjustment to be made very accurately, an adjustment shaft 104 is rotatably mounted in the cutter slide 96 with the stub end 104' of this shaft 104 disposed eccentrically and passing through the clamp member 100. When the screw 102 is loosened, the adjustment shaft 104 can be turned to adjust the position of the clamp member 100. Thus, the position of cutter 38 (relative to the cutter slide 96 in the direction of the arrow C) can be adjusted precisely. After the adjustment is made, the clamp member 100 and the cutter can then be clamped tight again by tightening the screw 102.

A flywheel mass 106 is mounted on the cutter drive shaft 90 in the end region remote from the cutting device 24 in order to ensure smooth running of the apparatus whenever the cutter 38 strikes against the wire 18.

The feed device 28 is disposed directly preceding the wire guide member 34. The feed device 28 comprises two feed wheels 110 and 112 which bound a feed gap 108 for the wire 18. The feed wheel 110, which is disposed above the wire 18, is mounted on a freewheel 114 acting in the supply direction B (FIGS. 3 and 8). The freewheel 114 is in turn mounted on a shaft stub 118 which is in the form of a hollow cylinder. The shaft stub 118 is rotatably mounted on a bearing shaft 116 which is fastened on the bearing block 32.

Figure 9:
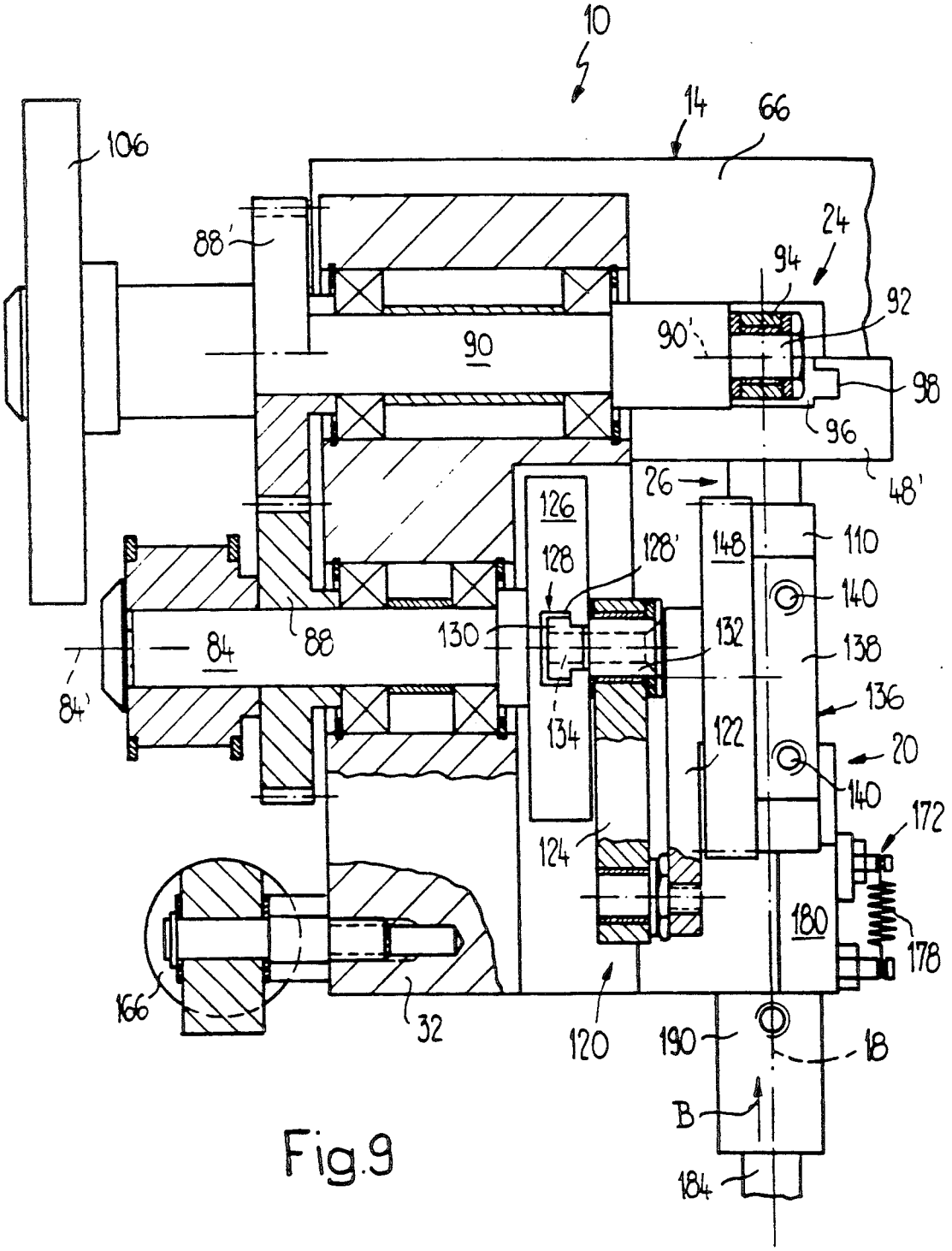

The feed wheel 110 is rotationally driven in a stepwise manner in the direction of the arrow E by means of a four-bar linkage 120 (see in particular FIGS. 3, 8, 9). An oscillating lever 122, which forms part of the four-bar linkage 120, is formed by a lever fastened to the shaft stub 118. The free end of the oscillating lever 122 is linked to a connecting rod 124, with the other end of the connecting rod 124 being mounted on a crank 126. The crank 126 is formed by a disk provided with a radially extending bearing slot 128 having a recess 128'. The crank 126 is continuously driven in the direction of the arrow F and is mounted on the drive shaft 84 for rotation with the latter. A bearing slide 130 is guided in the bearing slot 128 and is detachably clamped securely in its position (relative to the axis 84' of the drive shaft 84) by means of a screw 134. The screw 134 is screwed into the bearing slide and passes through a bearing pin 132. The angle through which the oscillating lever 122 turns for each revolution of the crank 126 can thus be adjusted by moving the bearing slide 130 relative to the axis 84'. This adjustment also determines the length of the starting portion of the wire which is fed through the outlet 36 into the recess 42 in the receiver member 40.

A brake device 136 acts on the feed wheel 110 by pressing a brake shoe 138 against the peripheral surface of the feed wheel 110. The brake shoe 138 is guided on two guide screws 140 so as to slide in the direction of the arrow C. The guide screws 140 extend parallel to one another and are disposed on an arm 142 which is fastened to the bearing block 132. The threaded stems of the guide screws 140 carry nuts 144. Compression springs 146 bear against the nuts 144 in order to press the brake shoe 138 against the feed wheel 110. The braking force can thus be adjusted by varying the position of the nuts 144.

A gear 148 is fastened coaxially at the side of each feed wheel 110, 112. The teeth of these gears mesh together and in each case project in the radial direction beyond the feed wheels 110, 112 (see in particular FIG. 8). The bottom feed wheel 112 is thus operatively connected to the feed wheel 110 and is driven stepwise oppositely to the latter, in the direction of the arrow E'.

The bottom feed wheel 112 is mounted for free rotation on a bearing shaft 152 which is in turn mounted on a pressure lever 150. The pressure lever 150 is comprised of two spaced apart lever plates 150' which extend parallel to one another, with one of the lever plates 150' extending on each side of the feed wheel 112. Each of the two lever places 150' is pivotally mounted at one end on a bearing pin 154 which projects from the bearing block 32. At their free end region, the two lever plates 150' are joined together by means of a pin 156. A compression spring 158 is supported on its top end on the pin 156 and on its bottom end on an adjusting screw 160 which is adjustable in the vertical direction. The force which clamps the wire 18 between the two feed wheels 110, 112 may be adjusted by turning the adjusting screw 160.

Figure 2:
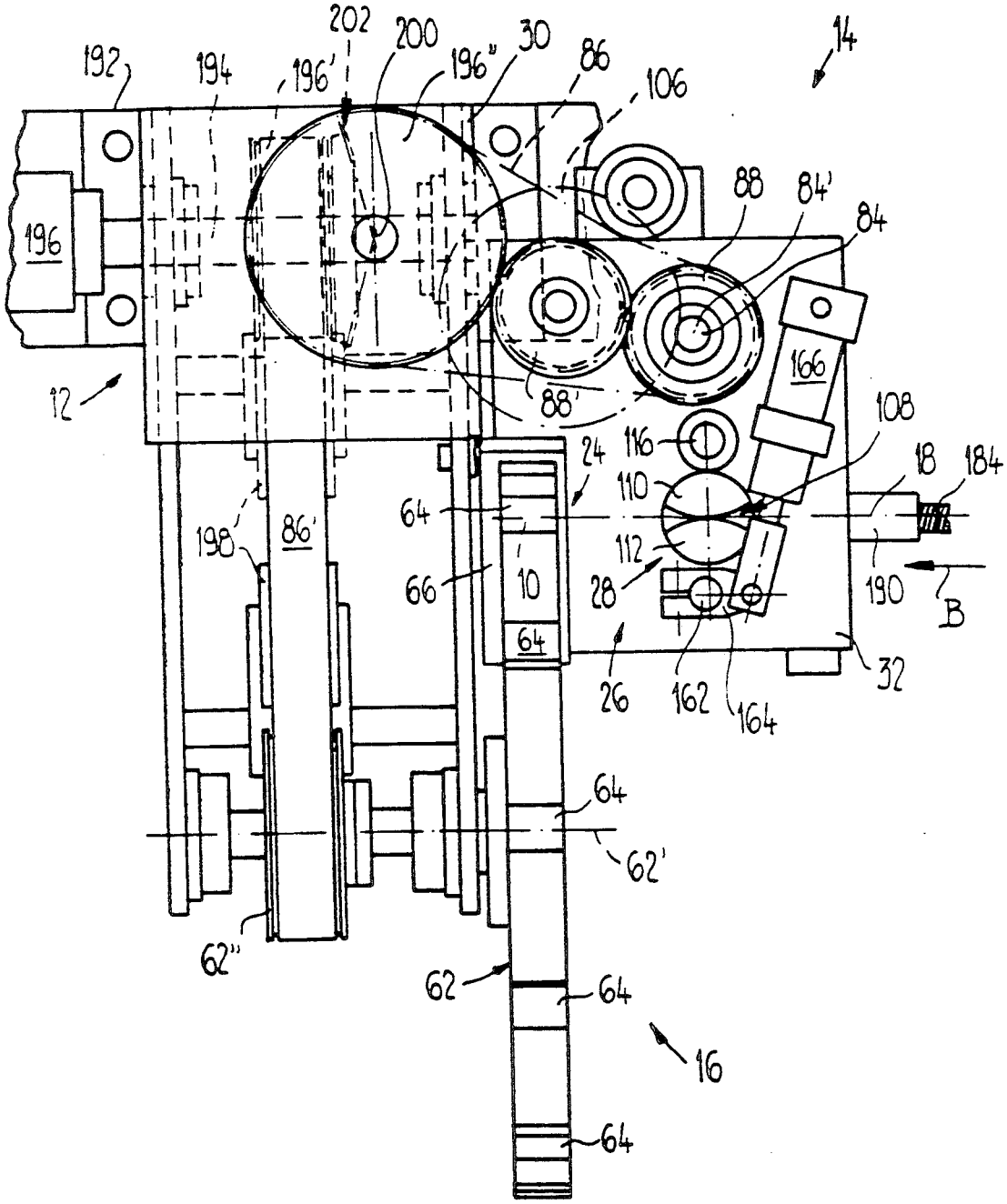
FIG. 2 is a side view of the apparatus of FIG. 1, viewed in the direction of the arrow II.

A lift-off shaft 162, whose axis is designated 162', is provided in the longitudinal direction of the pressure lever 150. The lift-off shaft 162 is mounted for free rotation on the bearing block 32. The lift-off shaft 162 is mounted such that it is disposed offset from the axis 152' of the bearing shaft 152. The lift-off shaft 162 is pivoted by means of a cylinder-piston unit 166 which acts through a driving lever 164 (FIG. 2). At the end facing the pressure lever 150, the lift-off shaft 162 includes an approximately horizontal stop surface 168. The stop surface 168 is disposed above a shaft stub 170 which projects beyond the respective lever plate 150' in the direction of the lift-off shaft 162. In order to lift the bottom feed wheel 112 off the wire 18, the lift-off shaft 162 has to be pivoted, by means of the cylinder-piston unit 166, in the counterclockwise direction out of the position shown in FIG. 3. If the lift-off shaft 162 is thereupon pivoted back in the clockwise direction, the pressure lever 150 and thus also the feed wheel 112 are raised again by the force of the compression spring 158. The two feed wheels 110, 112 may have to be lifted off one another, in order for example to insert a new wire 18 or, without having to stop the drive of the machine, in order to interrupt the stepwise feeding of the wire 18. The pivotable articulation of the cylinder-piston unit 166 on the bearing block 32 is best illustrated in FIG. 9.

A return stop means 172 acting on the wire 18 precedes the two feed wheels 110, 112, when viewed in the supply direction B. This stop means 172 comprises two non-rotatably mounted disks 174, 174' which receive the wire 18 between them. The bottom disk 174 is disposed in a stationary position on the bearing block 32. The other disk 174 is disposed on the free end of a lever 176, shown in dot-dash lines, pivotally mounted on the bearing block 32. The lever 176 is biased in the clockwise direction (FIG. 3) by means of a tension spring 178 (shown in FIG. 9). Since the angle between the wire 18 and the longitudinal direction of the lever 176 amounts to almost 90°, a powerful clamping force can be exerted on the wire 18 by means of a relatively small force provided by the spring 178. The return stop means 172 is covered by a cover member 180, which has a window for the two disks 174, 174' and closes a guide passage 182 for the wire 18. The cover member 180 is adapted to the contour of the feed wheels 110, 112 in order to guide the wire 18 in the guide passage 182 to a point close to the feed gap 108.

The wire 18 is unwound in known manner from a magazine reel and guided in a flexible hose 184 to the beginning of the guide passage 182. At that point, the end region of the hose 184 is held in a connection sleeve 186. The connection sleeve 186 is inserted into a tubular adaptor 190 which is fastened on the bearing block 32.

The drive unit 12 (FIGS. 1 and 2) is fastened on a frame 192 and is of box-like construction. The walls of the drive unit 12 serve as bearing plates for the shafts. The bearing block 32 is fastened to one of these bearing plates, namely the bearing plate 30. A driven shaft 194, which extends parallel to the axis of rotation 62' of the take-over wheel 62, is connected to a drive 196 (schematically illustrated). A driven wheel 196' is mounted on the driven shaft 194 to rotate therewith. The driven wheel 196' is operatively connected to the take-over wheel 62 by means of a cogged belt 86', which is likewise guided around a wheel 62''. The cogged belt 86' is passed around two guide wheels 198 in order on the one hand to tension the cogged belt 86', and on the other hand to ensure free access to the wire piece dispenser 14 and to the take-over wheel 62. The cogged belt 86 is operatively connected to the drive shaft 84 of the wire piece dispenser 14. The cogged belt 86 is guided around another driven wheel 196''. The driven wheel 196'' is mounted on a shaft 200 which extends at right angles to the driven shaft 194. The cogged belt 86 thus rotates with the shaft 200, the latter being coupled by bevel gearing 202 to the driven shaft 194.

The apparatus shown in FIGS. 1 to 9 works in the following manner. The cylinder-piston unit 166 is actuated for insertion of the wire 18, whereby the lift-off shaft 162 is pivoted in the clockwise direction in FIG. 2 and in the counterclockwise direction in FIG. 3. The stop surface 168 presses the shaft stub 170 downwards, whereby the feed wheel 112 is lifted thus pivoting the pressure lever 150 of the feed wheel 110 which is mounted in a fixed position. The wire 18 fed forward through the hose 184 is automatically inserted by its starting portion into the guide channel 182. It should be noted that all inlets or transitions along the guide path of the wire 18, viewed in the supply direction B, taper conically and thus no stop surfaces stand in the way of the starting portion of the wire. As the wire is pushed further forward, its starting portion runs between the two disks 174, 174' of the return stop means 172, pivoting the lever 176 against the force of the tension spring 178. As the wire 18 is further pushed, it is guided through the guide channel 182, inserted into the feed gap 108 between the feed wheels 110, 112, which have been lifted apart, and passes to the conical inlet 52' of the guide sleeve 52. As it is still further pushed, the wire 18 passes into the nozzle-shaped passage 56 and is fed forward to the outlet 36. The cylinder-piston unit 166 is then relieved of load, so that through the force of the compression spring 158 the bottom feed wheel 112 is now pressed against the top feed wheel 110, thus clamping the wire 18.

While the drive 196 is running, the wire 18 is fed forward by the feed device 28 during half a rotation of the crank 126. The wire is fed for the length of a piece which is determined by the effective length of the crank 126. During the time taken up by the remaining half-rotation of the crank 126 the wire 18 is stationary. Return movement of the wire 18 is prevented by the return stop means 172. The brake device 136 provides defined braking of the feeding of the wire 18 on the corresponding reversal of direction of the oscillating lever 122. As described above, as the wire 18 is fed, the starting portion of the wire is methodically controlled by the wire guide member 34 to advance into the recess 42 in the receiver member 40. During the time in which the wire 18 is stationary, the cutter 38 cooperates with the outlet 36 to cut off the wire piece 10 from the wire 18. It should be noted that during the feeding of the wire the cutter 38 is drawn back from the region of the outlet 36.

The take-over wheel 62 is driven by the drive 196 in synchronism with the wire piece dispenser 14. Before the wire 18 is cut through, the opening 44 of the recess 42 is in each case closed by a take-over member 64 which is moving past. The cut off wire piece 10 drops onto the take-over member 64 and into the depression 86 formed therein. Here the wire piece 10 is held securely by the magnet 70 and is carried on to the driver flank 68'. As soon as the recess 42 has been emptied, the feed device 28 can now feed the wire 18 one step further forward. In the course of one work cycle of the wire piece dispenser 14, the take-over wheel 62 is continuously moved further by one twelfth of a rotation, so that each take-over member 64 is fed with a wire piece 10 as it moves past the receiver member 40. As the take-over members 64 move past the wire piece straightening device 72, the wire piece 10 is, if necessary, moved into the correct position. As a take-over member 64 passes the delivery position 80, the corresponding wire piece 10 is taken over by the punch 22, which is moving past at a higher speed in the direction of the arrow A. Thus, the corresponding take-over member 64 is now ready to receive a new wire piece 10.

Although the invention has been described above with respect to the presently preferred embodiments, other embodiments are possible. For example, the stapling head or heads may be guided directly past the receiver member 40 for the purpose of taking over a wire piece 10. It is of course also possible for the wire piece dispenser 14 to be disposed directly on a stapling head and to guide the punch 22 of the stapling head past the receiver member 40 for the purpose of taking over the wire pieces 10. The take-over member can obviously move along any path guiding it past the receiver member.

If the recess is open at the side or at the top, the wire piece is preferably pulled towards the receiver member by means of a magnet disposed in the latter. In other embodiments, it is however also possible to provide a ram or gripper in order to bring the wire piece which is lying loose in the recess to the take-over member.

Although the present invention has been described above with reference to the presently preferred embodiments of the invention, it will be recognized by those skilled in the art that many other variations are possible. It is intended that the invention be defined by the following claims, including all equivalents.

I claim:

1. An apparatus for preparing wire pieces from a wire for a stapling device which staples together multi-page printed products, such as newspapers, magazines and the like, the apparatus comprising:

a wire piece dispenser having a supply mechanism and a cutting mechanism, the supply mechanism including a feed mechanism which supplies a wire in a step-wise manner, in a supply direction, to the cutting mechanism, the cutting mechanism performing a cutting operation wherein the supplied wire is cut into wire pieces;

a receiver member disposed downstream of the cutting mechanism, the receiver member receiving a wire piece cut from the wire by the cutting mechanism;

the receiver member including a groove-like recess, the recess aligned with the supply mechanism and configured to surround with tolerance the starting region of the wire piece, the opening of the recess configured to allow the free passage of the wire piece;

a take-over member for taking over and transporting the wire piece from the receiver member, the take-over member adapted to move past the receiver member substantially at right angles to the longitudinal direction of the wire piece and close the opening of the recess as it moves past; and the movement of the take-over member and the receiver member synchronized such that the take-over member closes the opening of the recess as the takeover member moves past the opening of the recess at the latest by the end of the cutting operation.

2. The apparatus as claimed in claim 1 wherein the recess, viewed in the supply direction, has a greater depth at the beginning than at the end.

3. The apparatus as claimed in claim 1 wherein the take-over member includes a groove-like depression and a magnet for entraining and holding the wire piece.

4. The apparatus as claimed in claim 3 wherein the groove-like depression is bounded by a driver flank.

5. The apparatus as claimed in claim 1 wherein the supply mechanism includes an adjustable wire guide member for the insertion of the starting region of the wire into the recess, and wherein the wire guide member precedes the cutting mechanism relative to the supply direction.

6. The apparatus as claimed in claim 5 wherein the guide wire member:

includes a nozzle-shaped outlet for the wire; and further comprises a guide member, the guide member preceding the outlet relative to the supply direction, and the guide member adapted to act on the wire approximately at right angles to the wire and being adjustable in position, wherein the guide member acting on the wire ensures that the beginning of the wire remains in the recess when the wire is fed into the recess.

7. The apparatus as claimed in claim 6 wherein the guide member comprises a shaft part which projects in the axial direction from, and is disposed eccentrically on, a shaft, the shaft being rotatable about its longitudinal axis and extending transversely to the wire, wherein the shaft part is caused to act on the wire by turning the shaft.

8. The apparatus as claimed in claim 1 wherein the cutting mechanism includes a blunt cutter cooperating with the supply mechanism to cut through the wire.

9. The apparatus as claimed in claim 1 wherein the feed mechanism comprises two feed wheels which bound a feed gap for the wire and a four-bar linkage including a crank and an oscillating lever, at least one of the feed wheels being connected through a freewheel, which acts in the supply direction, to the oscillating lever of the four-bar linkage.

10. The apparatus as claimed in claim 9 wherein the effective length of the crank of the four-bar linkage is adjustable such that the feed of the wire per revolution of the crank is adjustable.

11. The apparatus as claimed in claim 9 further comprising a brake which acts on at least one of the feed wheels.

12. The apparatus as claimed in claim 9 further comprising:

a pressure lever, wherein one of the feed wheels is mounted on a bearing shaft on the pressure lever, the pressure lever being swivelably mounted in a fixed position and being biased towards the other feed wheel; and a lift-off shaft mounted in a fixed position approximately in the longitudinal direction of the pressure lever and offset relative to the axis of rotation of the feed wheel, the lift-off shaft having a stop surface, wherein, by turning the lift-off shaft, the stop surface can be brought to bear against one of the bearing shaft and the pressure lever to raise the feed wheel oppositely to the biasing direction.

13. The apparatus as claimed in claim 1 further comprising a return stop which acts on the wire oppositely to the supply direction.

14. The apparatus as claimed in claim 1 further comprising a wire piece straightening device including two lateral straightening members which are adjustable in their position transverse to the direction of movement of the take-over member, wherein the recess is followed, viewed in the direction of movement of the take-over member, by the wire piece straightening device.

15. The apparatus as claimed in claim 8 wherein the cutter is adjustably fastened on an alternatingly drivable slide.

16. The apparatus as claimed in claim 1 wherein the take-over member is disposed on a stapling head of a stapling machine.

17. The apparatus as claimed in claim 1 wherein the take-over member is disposed on a continuously drive conveyor member for conveying the wire piece to a stapling head of a stapling machine.

18. The apparatus as claimed in claim 1 wherein the recess is open at the bottom.

* * * * *

UNITED STATES PATENT AND TRADEMARK OFFICE

CERTIFICATE OF CORRECTION

PATENT NO. :5,113,732
DATED :May 19, 1992
INVENTOR(S) :Egon Hänsch

It is certified that error appears in the above-indentified patent and that said Letters Patent is hereby corrected as shown below:

In column 4, line 29, after "60" insert --.--.

In column 6, line 5, delete "78." and substitute therefor --78,--.

In column 8, line 7, delete "machine." and substitute therefor --machine,--.

In claim 17, column 12, line 32, delete "drive" and substitute therefor --driven--.

Signed and Sealed this

Twenty-third Day of August, 1994

Bruce Lehman

*Attest:*

BRUCE LEHMAN

*Attesting Officer*

*Commissioner of Patents and Trademarks*